US006749527B2

(12) United States Patent
Hughes

(10) Patent No.: US 6,749,527 B2
(45) Date of Patent: Jun. 15, 2004

(54) PORTABLE GOLF GREENS SPEED METER

(76) Inventor: Joe Leonard Hughes, 4981 Lake Fjord Pass, Marietta, GA (US) 30068

( * ) Notice: Subject to any disclaimer, the term of this patent is extended or adjusted under 35 U.S.C. 154(b) by 0 days.

(21) Appl. No.: 10/299,077

(22) Filed: Nov. 19, 2002

(65) Prior Publication Data

US 2004/0097303 A1 May 20, 2004

(51) Int. Cl.[7] ..... A63B 57/00
(52) U.S. Cl. ..... 473/404
(58) Field of Search ..... 473/404, 279, 473/157, 160, 162; 33/313

(56) References Cited

U.S. PATENT DOCUMENTS 1,014,555 A * 1/1912 Zimdars ..... 473/157
1,662,864 A * 3/1928 Petersen ..... 473/160
3,727,917 A * 4/1973 MacLean ..... 473/160
3,908,991 A * 9/1975 Schwartz ..... 473/404
5,431,403 A * 7/1995 Pelz ..... 473/160
5,669,832 A * 9/1997 Lehse ..... 473/404
5,863,256 A * 1/1999 MacLean et al. ..... 473/160
6,547,680 B1 * 4/2003 Marchese, Jr. ..... 473/404

* cited by examiner

*Primary Examiner*—Steven Wong

(57) ABSTRACT

This device presented here is a portable, collapsible greens speed measuring instrument to aid golfers in putting. It has been difficult for golfers to have accurate readings of the putting green speed since most golf courses do not evaluate their greens. This invention will do this for the golfer. The device is inexpensive, light, convenient, and easy to use, which is in sharp contrast to the stimpmeter used today in professional circles. This device folds into a small size, approximately 8 inches, in contracts the the stimpmeter used now which is about 30 inches. The presently used device is expensive and is not collapsible. It is difficult to use and unavailable at most golf courses. It is for these reasons there is a strong need for a portable greens speed meter presented here for the average or the professional golfer.

1 Claim, 11 Drawing Sheets

1
2
3
5
6

1
2
3
5
6
7
12
13

6b
8b
10b
6d
6c
6a
8a
1
10a 11b
12b
12a
5
13b
13a
2
9b
15b
11a
15a
9a
3

PORTABLE GOLF GREENS SPEED METER

BACKGROUND

In the game of golf, putting the ball on the green is of utmost importance. It can account for half of the score and therefore can easily win or lose the game for you. The fewer strokes it takes to get the ball into the hole, determines the winner. After the golf ball is driven off the tee it then goes onto the fairway, or maybe onto the putting green, the ball is stroked until it reaches the green surface. Again the ball is stroked until it goes into the hole. Each stroke here counts the same as a stroke, the 240 yard drive, the 150 fairway shot, and the putt which may be 3 feet. The golfer must be able to know how firmly to strike the ball to accelerate the ball to the hole and yet not go past the hole. If the ball passes over or beyond the hole it may take one or more strokes to get it back and into the hole. If it does not reach the hole, it cannot go into the hole. It is imperative for the golfer to have the knowledge to be able to tell how fast the ball will travel on this surface at this time.

The surface of the green can slow down the speed of the ball or allow it to roll very fast over it's surface. The surface is affected by a number of factors. On a level surface the height of the grass, moisture, cut of the grass, fertilization, temperature, wind velocity, type of grass, and other factors will affect how fast or slow the ball travels over the surface. The speed of the green can change hourly, making it even more difficult to evaluate. This invention was developed to help the golfer evaluate this surface speed easily.

In 1937, Mr. Edward Stimpson invented an instrument he called a stimpmeter. This instrument was and still is used as the standard for evaluating the greens speed. It does an excellent job and is used by the professionals on most all the tournaments. The greenskeepers of the golf club rate the greens and give each one a score. The stimpmeter can be purchased from England for 52 pounds. This is approximately $81 to $120 depending on the pound value at the time. The stimpmeter can also be purchased through some places in the United States but they are not routinely sold by many stores here. The stimpmeter is a long V-shaped aluminum rod that has a trigger at the top for release of the golf ball. The bar or rod end is laid on the ground and the loading end held up to make a 20 degree angle with the ground. The ball is then placed on the top of the trough and then released by the use of the trigger. The ball then rolls down the trough and onto the putting surface. The ball will travel as far as the green will allow and this distance is measured. The distance it travels is then compared with a standard chart which indicates what the rating will then be on this green. As an example, if the ball travels 5 feet on the putting surface, the rating may be 0–4 feet=slow, 4–6 feet=medium and 6–8 feet fast, then the rating would be medium speed. However, there is usually more specificity to the rating and the 5 foot distance may be considered a slow-medium, or just the number 5. The professionals usually have the number figure for the ratings provided to them. Therefore, if the ball rolls 11 feet, then the rating for that green is 11.

Most golf courses in the United States do not rate or grade the greens. This is for a number of reasons. One main reason is the personel needed to grade or rate the green. It is time consuming and requires some knowledge of the usage of the stimpmeter. It requires the purchase of the stimpmeter which is somewhat expensive. The rating of the green can change daily and if not read recently can give the golfer false information. This could anger the golfer if he is given erroneous information, and makes a poor putt based on the rating given to him.

The invention presented here is a new collapsible, portable, simple, golf greens speed meter which can be used by the amateur golfer or the professional. It is lightweight, inexpensive, and easy to use. It requires no expertise to use and is very accurate. It can be easily placed in, or on, the golfer's bag or into his pocket. It will give the golfer the information he needs on the putting surface of the green.

SUMMARY

There is a need for a greens speed meter to determine the speed of each green the golfer is putting on. The stimpmeter is large bulky and difficult to use. It is available for the professional golfer mainly and the average golfer never gets to have usage of it. Presented here is a device which can be purchased by the amateur golfer and used whenever he needs it. He can use it when the golf course attendants do not want to grade the greens or are unavailable to grade the green. The collapsible, portable greens meter presented here gives a very accurate reading of the green and in fact may be more accurate than the stimpmeter which is the standard. It differs from the stimpmeter also in that it is easily placed in the golfer's pocket or his golf bag. It also sits on the ground and is more stable than the stimpmeter. The angle is about 30 degrees incline for the ball route while the stimpmeter is 20 degrees. It will be made of plastic, although it could be made of aluminum or wood, and will be less expensive to the golfer. The golfer, even working with this device, will familiarize himself with the greens speeds and how to make a more accurate putt. The golfer will also know the evaluation is accurate and taken at his direction and at the time the putting is to be done.

DETAILED DESCRIPTION

Figure 1:
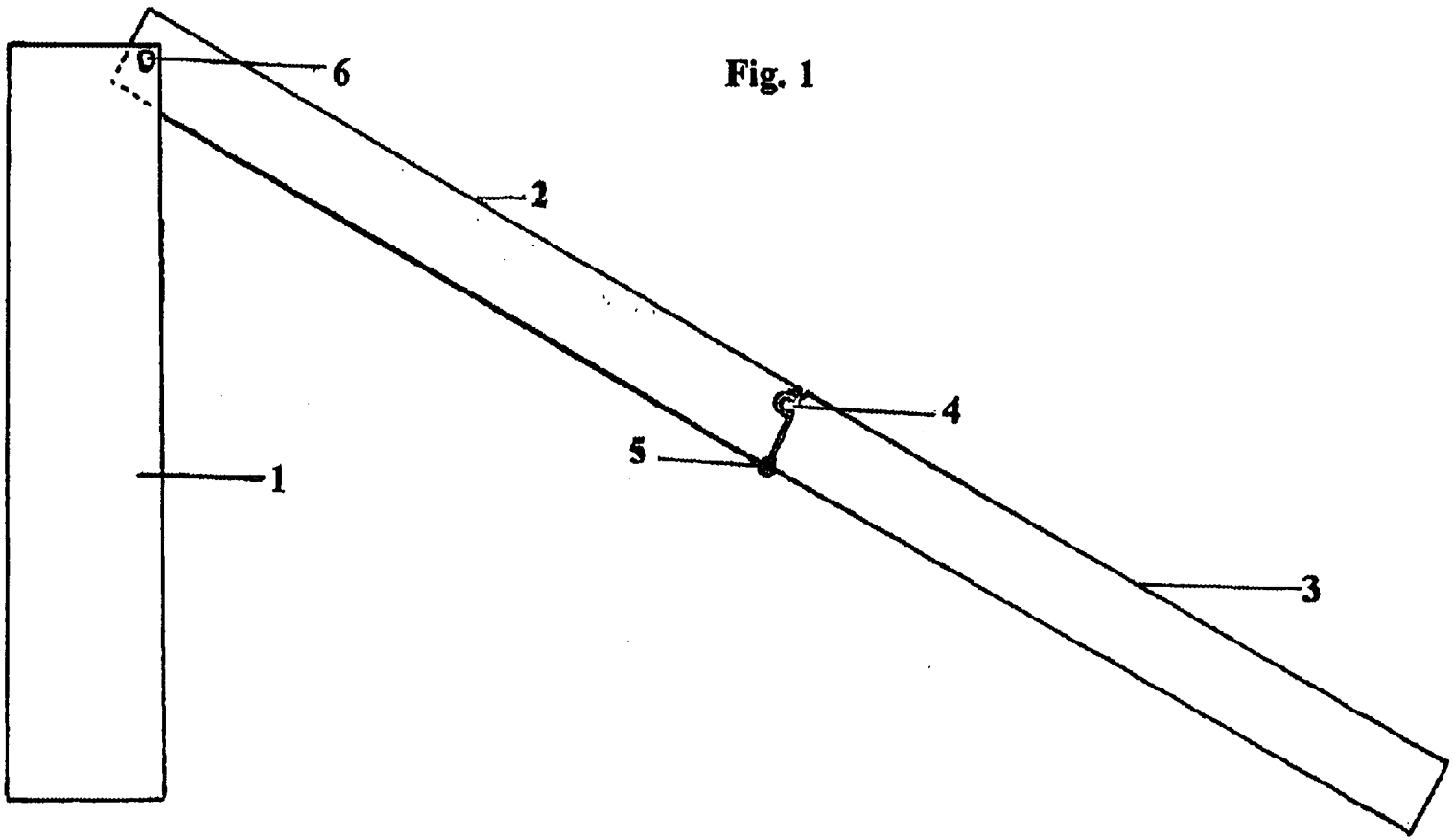
FIG. 1 is a lateral view of the invention in the performing position
Figures 2, 3:
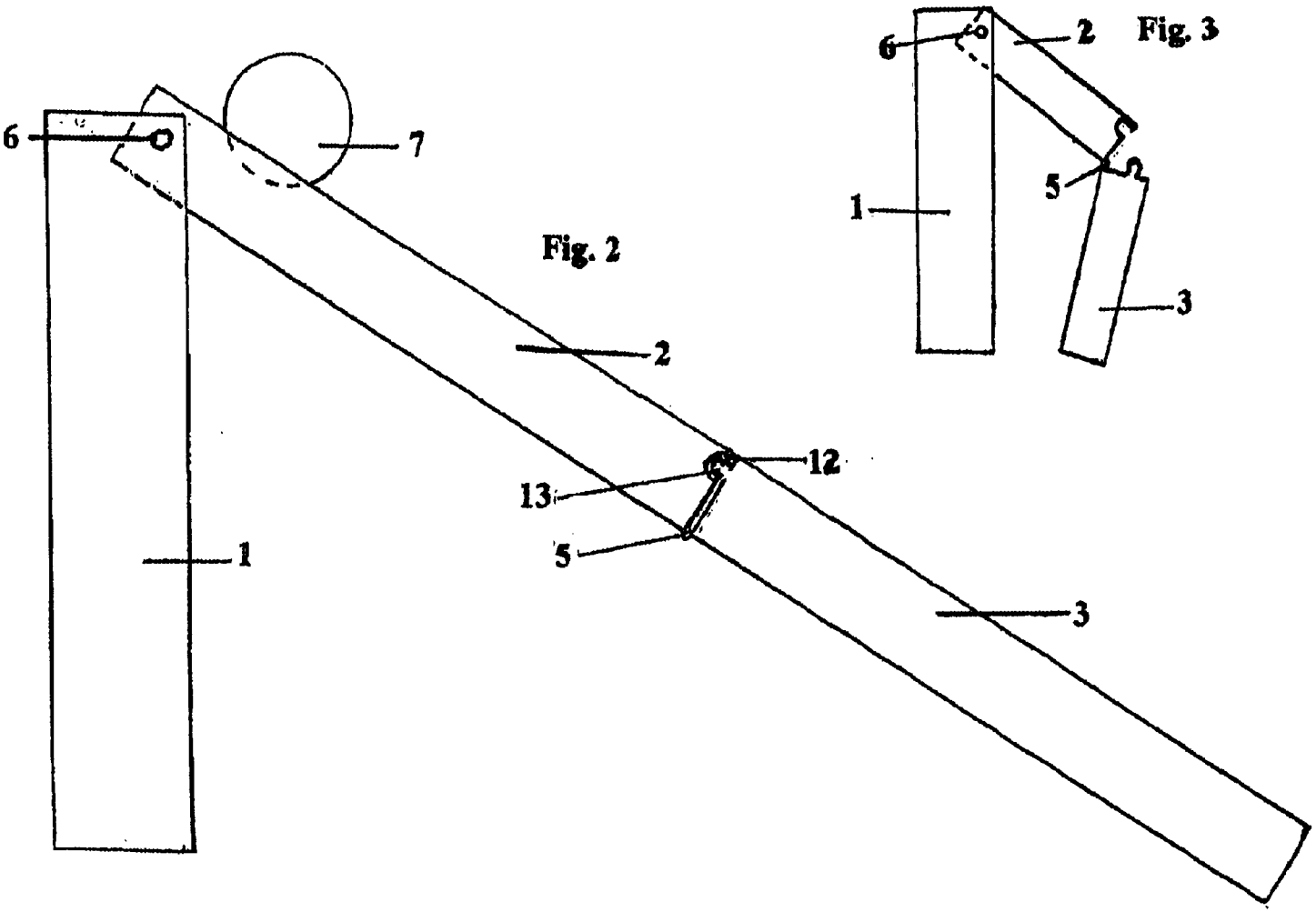
FIG. 2 indicates a side view of the speed meter in the functioning position and demonstrates it's locking position.
FIG. 3 is a view of the partially closed position.
Figure 4:
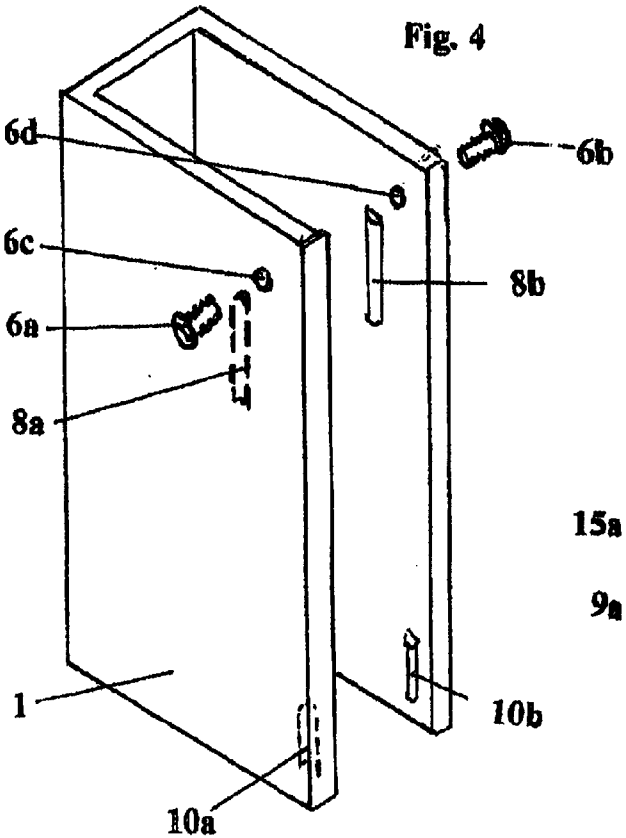
FIG. 4 shows the base portrion of the device to indicate how it contains and holds the rails for the ball ramp.

The invention presented here is a simple collapsible device for the measurement of the speed a ball travels across an area of turf. The designs are presented here in detail. The purpose of the device can be accomplished in more ways than one, and the designs of these methods are presented here. In FIG. 1, the speed meter is seen in a lateral or side view. There are ramps, 2 and 3 connected to the base stand 1, with a screw (or bolt) 6. Indicated by 5 is the hinge that allows this device to be collapsed and 4 shows the detent connections for holding the ramps connected while in the functioning position. FIG. 2 again shows the ramp 2 with a ball 7 in place to roll down ramp 2 and 3, thence onto the surface to measure the distance it travels. Again there is noted a hinge 5 at the bottom connecting ramp 2 and 3, and a snap connection of the top of the ramps. The snap connection is accomplished by the configuration of ramp ends with ramp 2 having a female reception or indention labeled 12 and ramp 3 with the male connecting component labeled 13. The FIG. 3 shows the manner the device collapses with the snap connection separating and the hinge 5 allowing flexion of the ramp 3 back and onto ramp 2. It will then be able to be flexed fully onto the undersurface of ramp 2 and then the two ramps can be flexed further into the base stand 1. FIG. 4 shows the base stand 1 with the connecting screws 6*a* and 6*b*, to hold the ramp 2 inside its surface. There are detents or protrusions of the surface 8*a* and 8*b* and 10*a* and 10*b* for holding the ramps 2 and 3 in correct positions. The 8*a* and 8*b* detents fit into slots 9*a* and 9*b* of the ramp 2, FIG. 5, and hold it in the correct position to allow the correct angle for the extended ramp 2 to be in alignment with the ground or surface. The FIG. 5 also indicates the collapsed position of ramp 3 under ramp 2 being connected with the hinge 5. The indentions at 12*a* and 12*b* are for the reception of the projection snaps 13*a* and 13*b*.

Figure 5:
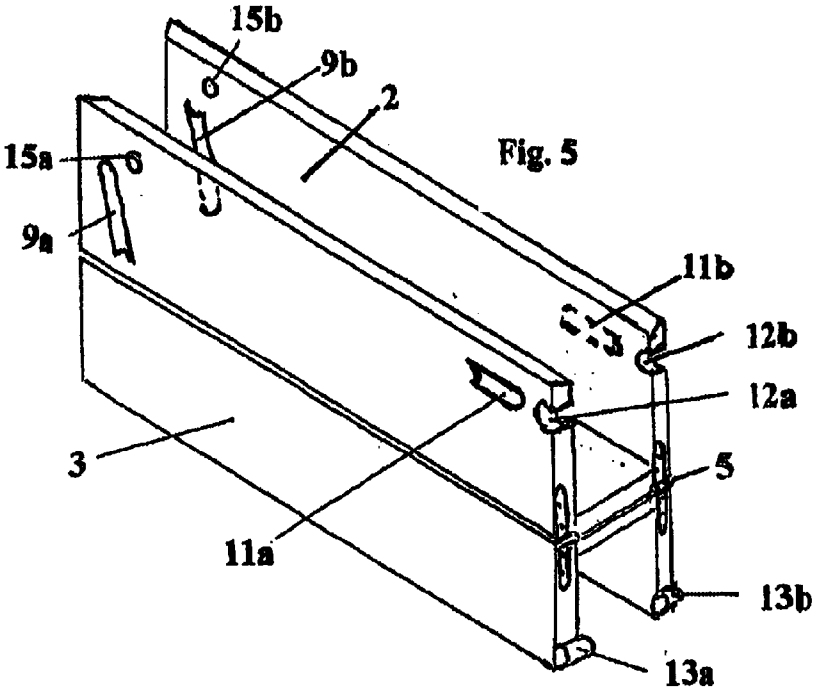
FIG. 5 shows the guide rails for the ball in a closed position.
Figures 6, 7:
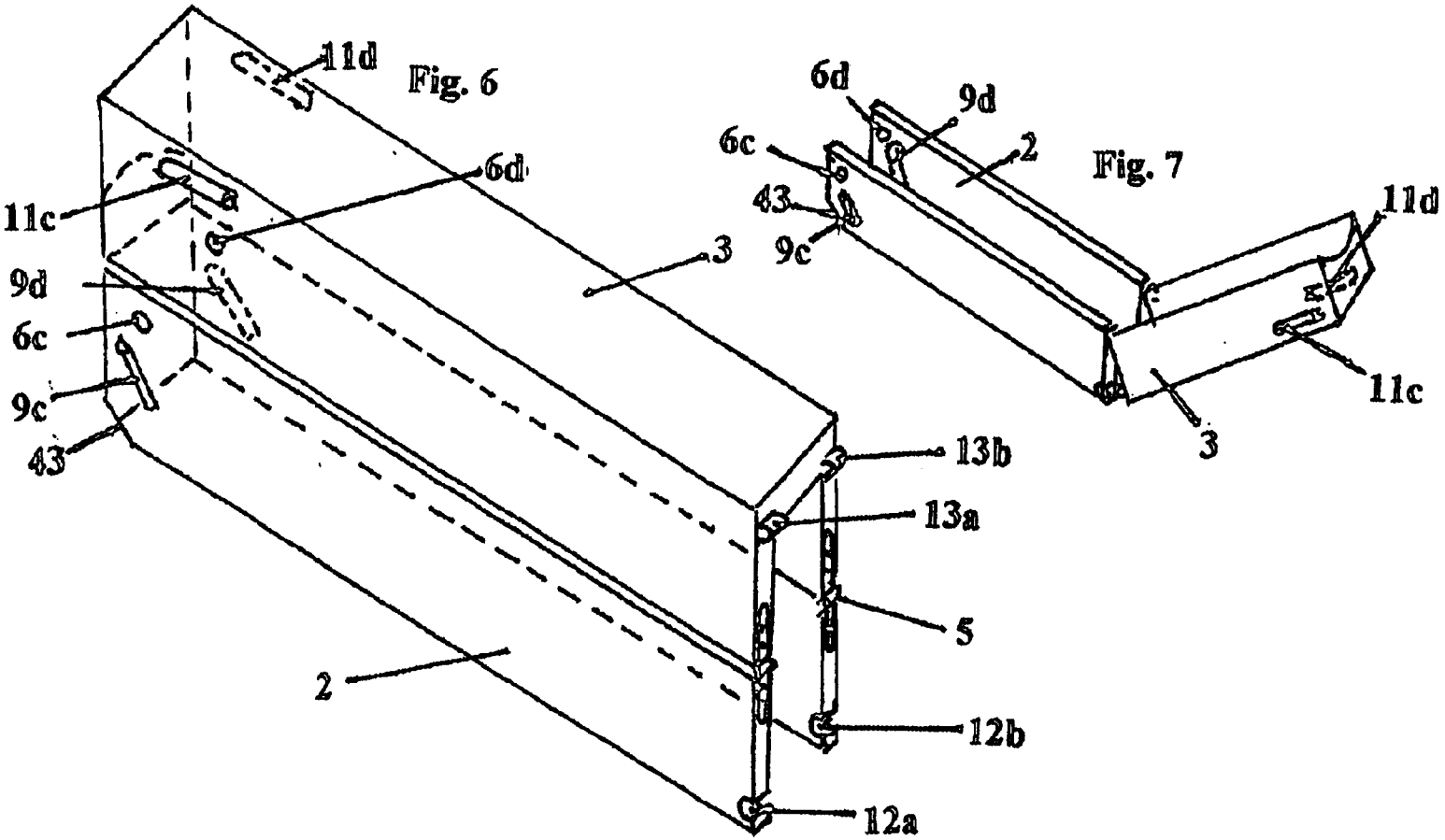
FIG. 6 shows the closed position of the rails with a top cover and hinge on the top of the bottom rail giving it the top position when extended.
FIG. 7 shows the opening position of the closed top rail design.
Figures 8, 9:
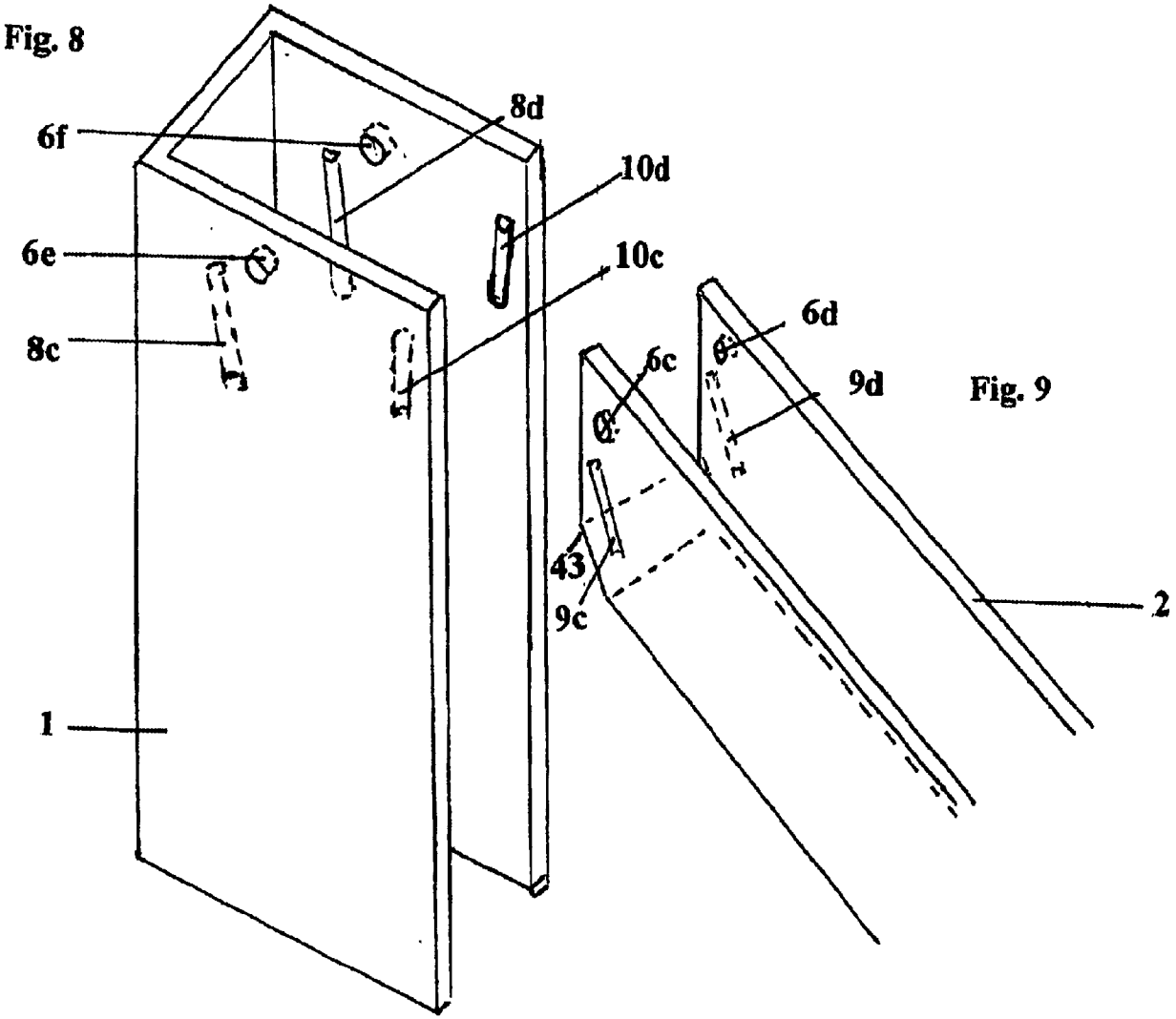
FIG. 8 shows the base stand and the detents which show how it can lock the rail in the correct position.
FIG. 9 shows the rail with concave indentions and how they fit into the convex ribs of the baseplate.

FIG. 6 shows the mirror image of FIG. 5. In this position the hinge 5 is located at the top of the ramps 2 and 3 when they are in the extended position. This allows for ramp 3 to be on top of ramp 2 when in the closed position. The connecting detents 12*a*, 12*b* and 13*a* and 13*b* are in the opposite positions and function to again hold the ramps in extension when the device is in the functioning position. Protruding detents 10*a* and 10*b* connect with the slotted detents of 11*a* and 11*b* to hold the ramps 2 and 3 inside the base stand 1 when fully collapsed. This would be the resting or nonfunctioning position. This closed position allows the instrument to open as ajack-knife would open and would be a more natural manner to open the device for usage. FIG. 7 demonstrates the incomplete open position of the device and shows the method how it remains collapsed inside the base stand 1. By the usage of the detents 9*c* and 9*d* on ramp 2, it allows the ramp to be aligned in the exact angle for the delivery of the ball down the ramp. The ramp 2 is located in the back of the base stand 1 and is connected to the base stand by screws at 6*c* and 6*f*. The completely closed position is maintained by the detents at 11*c* and 11*d*. With the position closed the method of opening it is simplified in the ramp 3 is pulled out of the closed position by breaking the detent holding positions and placing the ramp 3 in full extension. This then allows the detents at 12*a* and 12*b* to connect with 13*a* and 13*b* causing the ramps to lock in extension. The ramp 2 is then rotated from the base stand 1 to partial extension and to the point when the detents 9*c* and 9*d* lock into 8*c* and 8*d* located in the base stand 1. This is the position for the correct ramp angle with the ground and give an exact reproducible alignment for each ball rolls each time the device is used.

Figure 10:
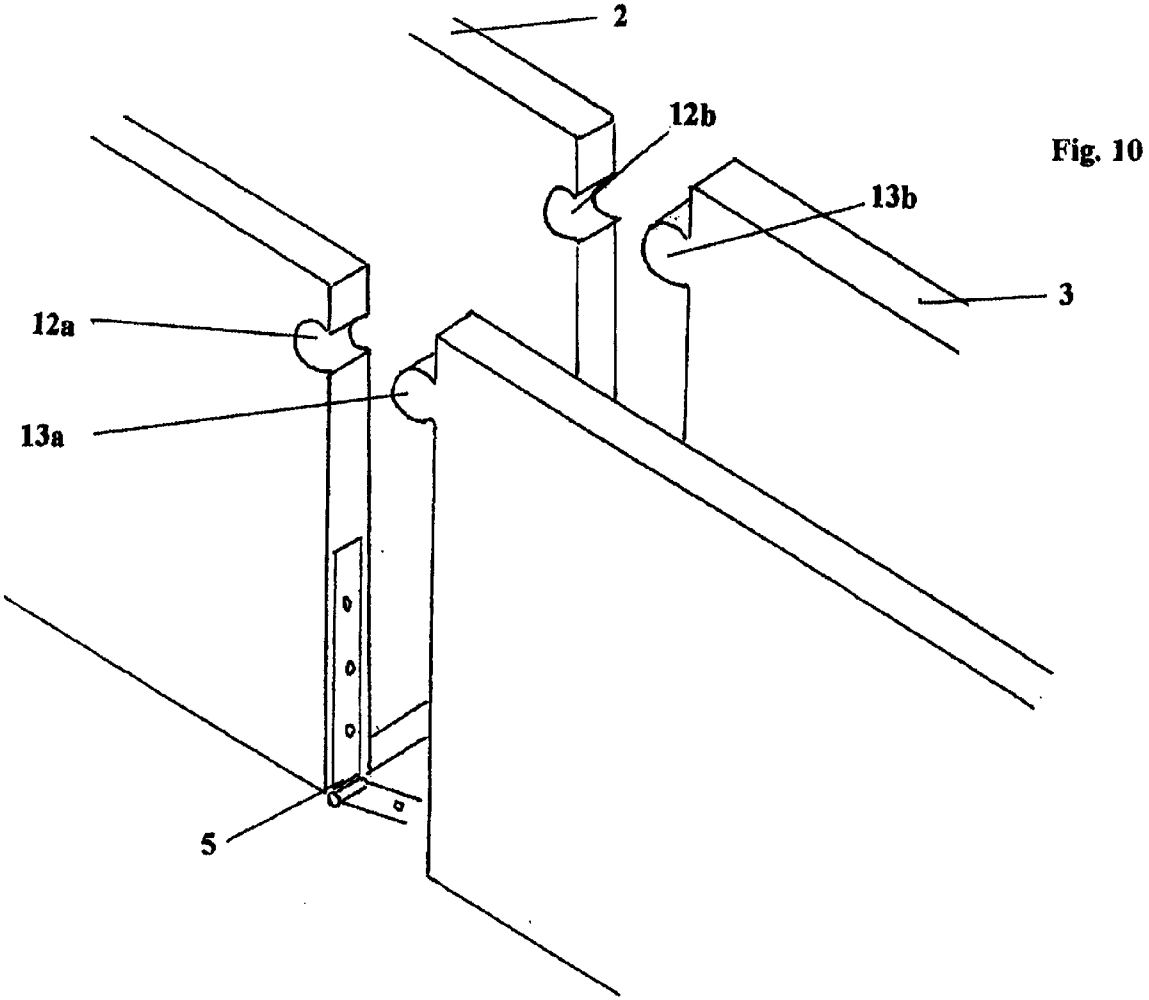
FIG. 10 shows how the connecting puzzle of the rails snap together with the bottom hinges closing the parts together.

The snap connections using the male detents 13*a* and 13*b* of ramp 3, seen in FIG. 10, to fit snugly into the female detents 12*a* and 12*b* of ramp 2. This drawing shows how the detents work by being compressed together by force and again separated by force.

Figure 11:
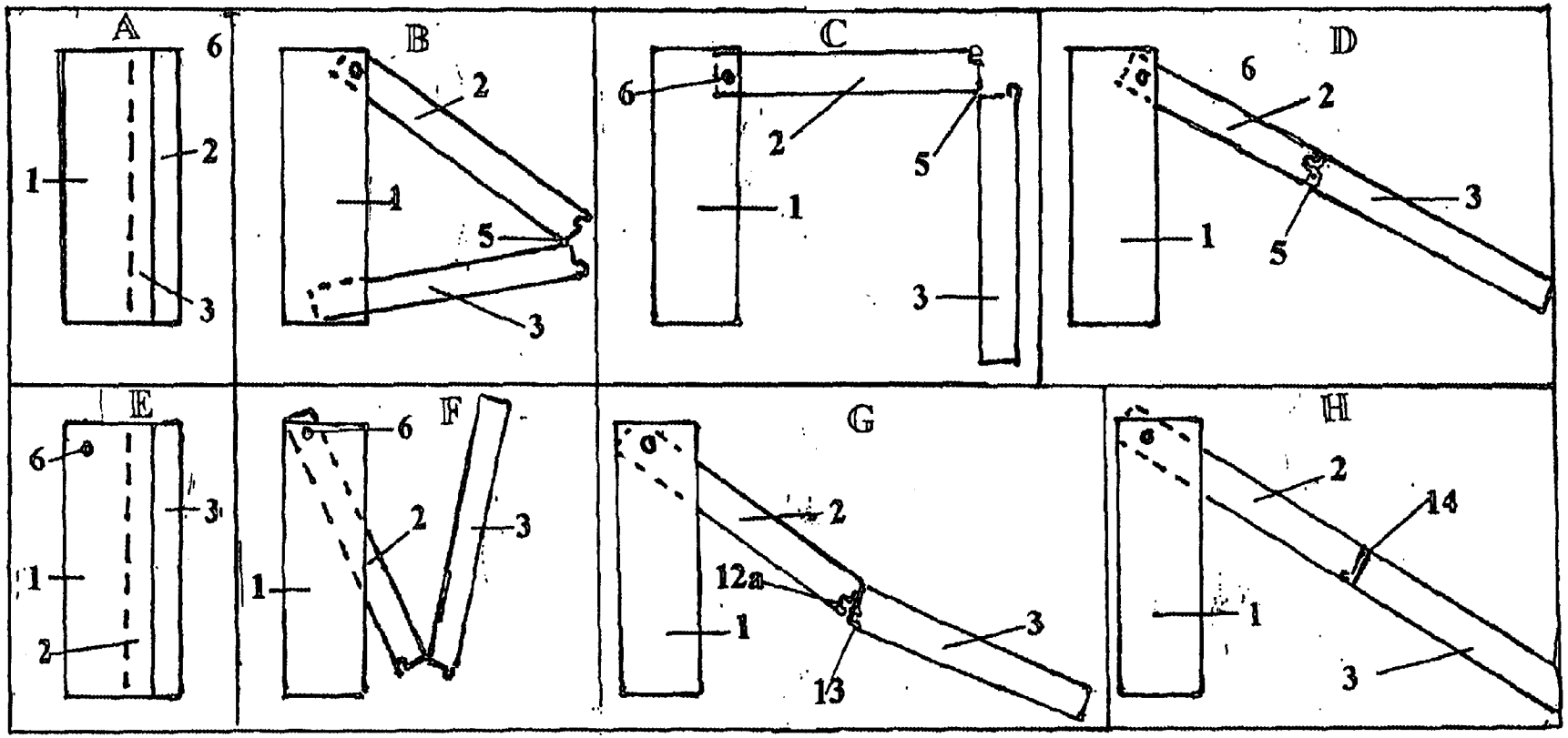
FIG. 11 this group of sketches shows how a bottom hinge and a top hinge can extend the rails. Both positions of the hinges accomplish the same purpose. The positions are different in that they change the position of the rails in the closed position in the base piece. They are each extended in a different method in which the lower hinge extends the rail from "inside out", the top hinge extends it's rail from "outside out" from their closed positions.

The position the device collapses to is seen in FIG. 11. The drawings A, B, C, and D show the method of opening the device from the closed position when the hinge is located in the bottom of the extended rails or ramps. The ramp 3 is collapsed into the base stand 1 in the most posterior or back position. The ramp 2 is in the front position and is positioned here by the attachment at 6 in the A diagram. The B diagram shows the partially opened position, again noticing the hinge 5 located on the bottom on the ramps. As extension continues, as seen in the C diagram, the ramp 2 must extend to 90 degrees or more for further extension of the ramp 3. As in diagram D full extension has occurred.

FIG. 11 shows the method of positions and actions when the hinge is located on the top of ramps 2 and 3. This is demonstrated in diagrams E, F, G, and H. As noted in E diagram, the ramp 2 is located in the rear or posterior position and functions here with its attachment 6 located there. The ramp 3 located in the front position moves out of the closed position E, to the partially open positions seen in F diagram and G diagram, and finally moves to the final position seen in diagram H.

Figure 12:
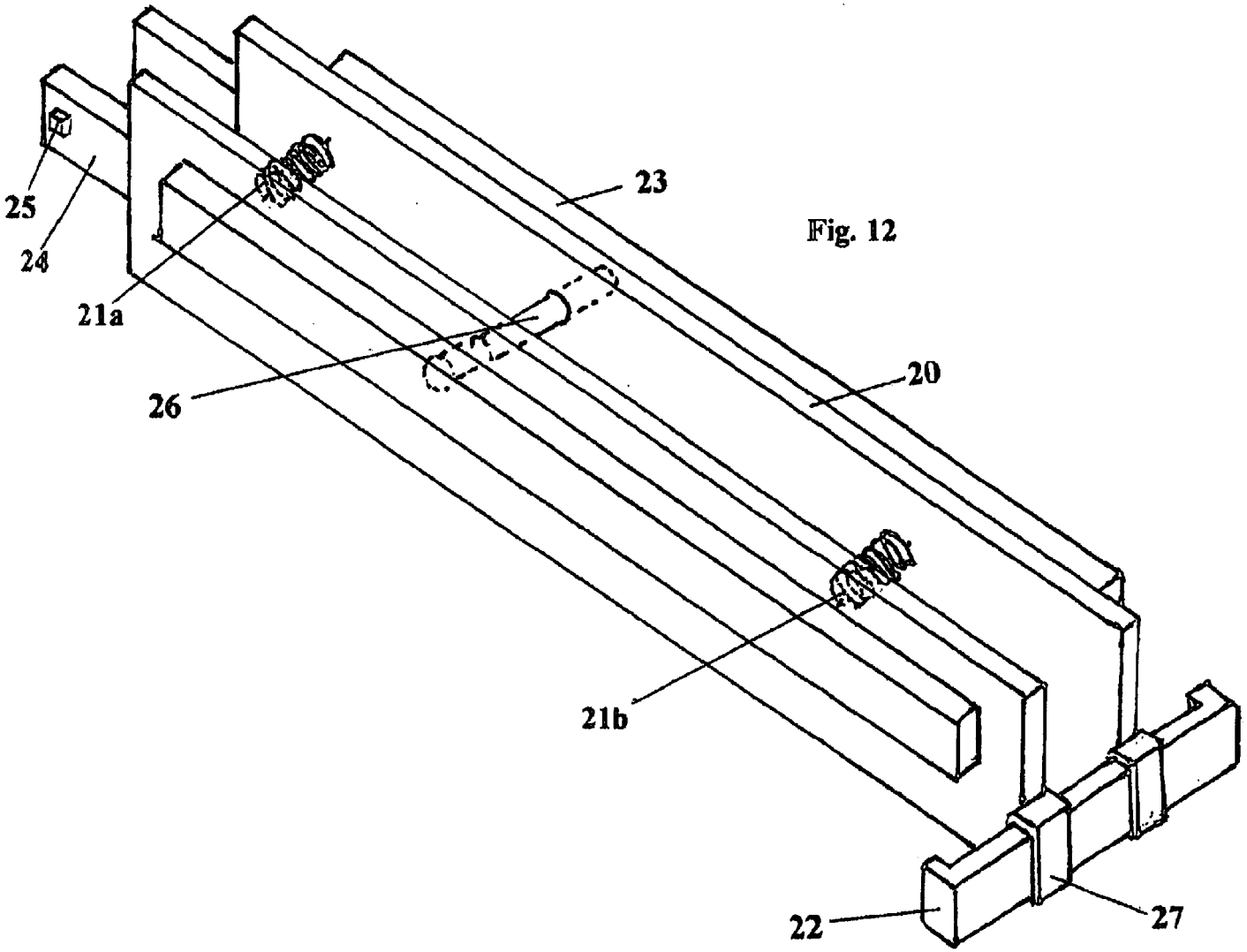
FIG. 12 shows another design in which the speed meter could be done. This shows a telescoping method in which the rails are collapsed inside each other.
Figure 13:
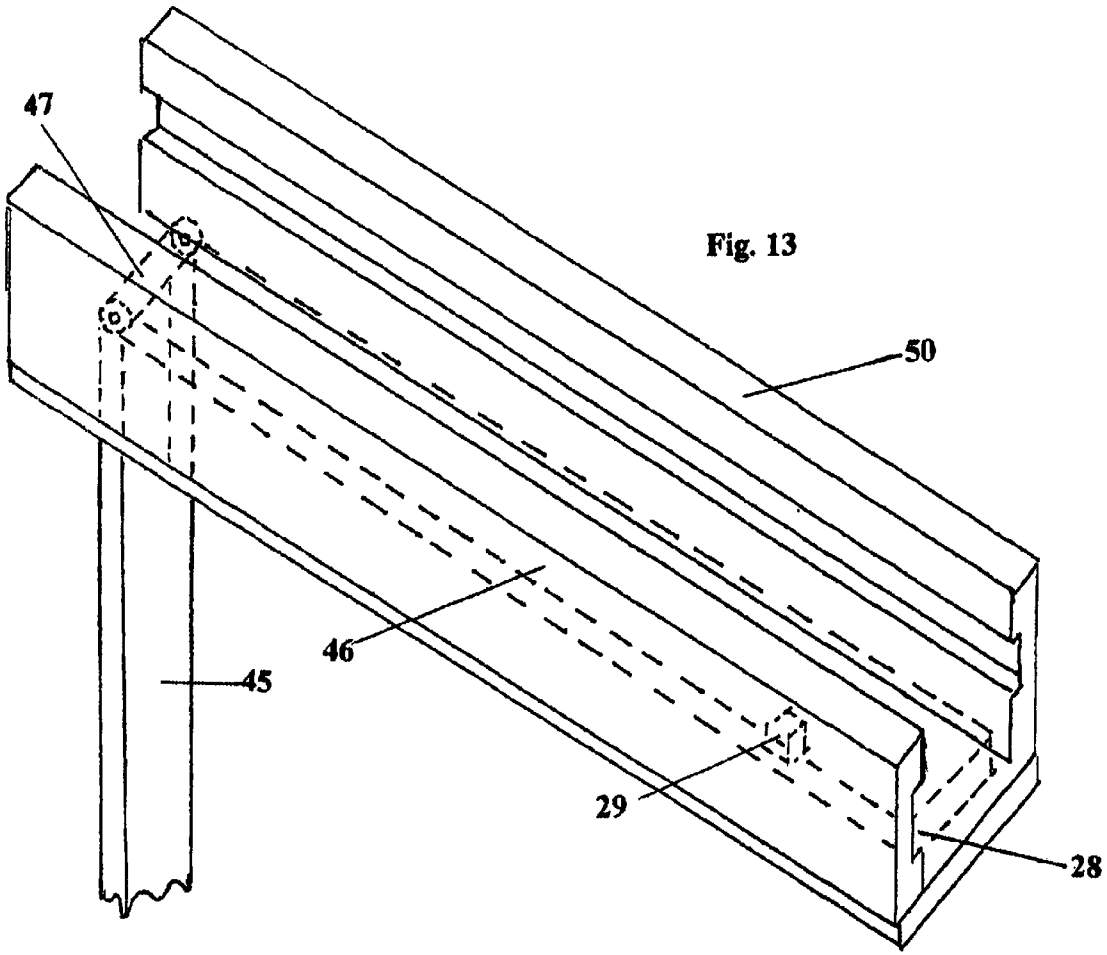
FIG. 13 indicates the receiving rail for the telescoping rail.

Other designs of a collapsible greens speed meter are possible. As seen in FIG. 12, an instrument that slides apart much like a slide rule. This would consist of two rails that are together by one collapsing inside the other. This is demonstrated in FIG. 12 which is an inside rail or ramp 20 that collapses by the use of two or more springs 21*a* and 21*b* which work with the use of one or more sliding bars to hold the system together 26 and by the use of the rails 23 that fit inside the external frame or ramp 50 in FIG. 13. The rails 23 fit inside the slots 28 allowing the ramps 20 and 50 to move from a collapsed position to extend to the fill length position of the instrument. When the inside rail 20 is pulled out completely, the ramps 20 expand laterally until restricted by the restricting bar 22. The two ramps 20 and 50 are still together by the connection of 24, which are extensions of the lateral rails 23 sizes that maintain the slot position on 28 slots. The stop 25 slides into the receptacle slot 29 thereby restricting the instrument from coming apart or allowing it to collapse again. Seen in FIG. 13 is the foldable stand 45 which is opened when the instrument is used. It then folds back into the bottom slotted position 46 when closed. The foldable stand 45 has attachment to the bottom by a bolt through its end into the surface of the base. Closure of the device is by squeezing the ramp 20 together, releasing the stop 25 by bringing it out of its receptacle, and sliding the frame lateral rails 23 back into 28 slots and telescoping it together. The restricting rod 22 snaps on the end and holds the mechanism together along with the spring action inside ramp 20. The folding base 45 fits snugly into the bottom slot 46 and is kept here by the pressure or detents.

Figure 14:
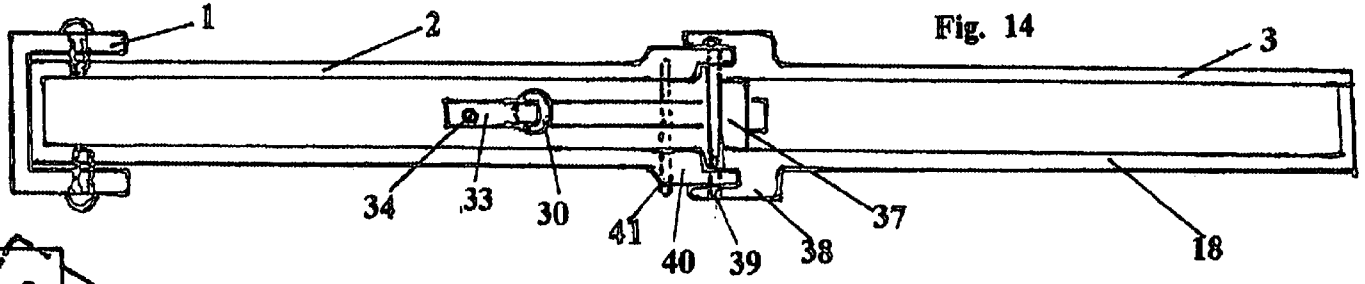
FIG. 14 reveals a top bview of the design #3 shows the same design as #1 but has a different rail locking mechanism on the bottom.
Figure 15:
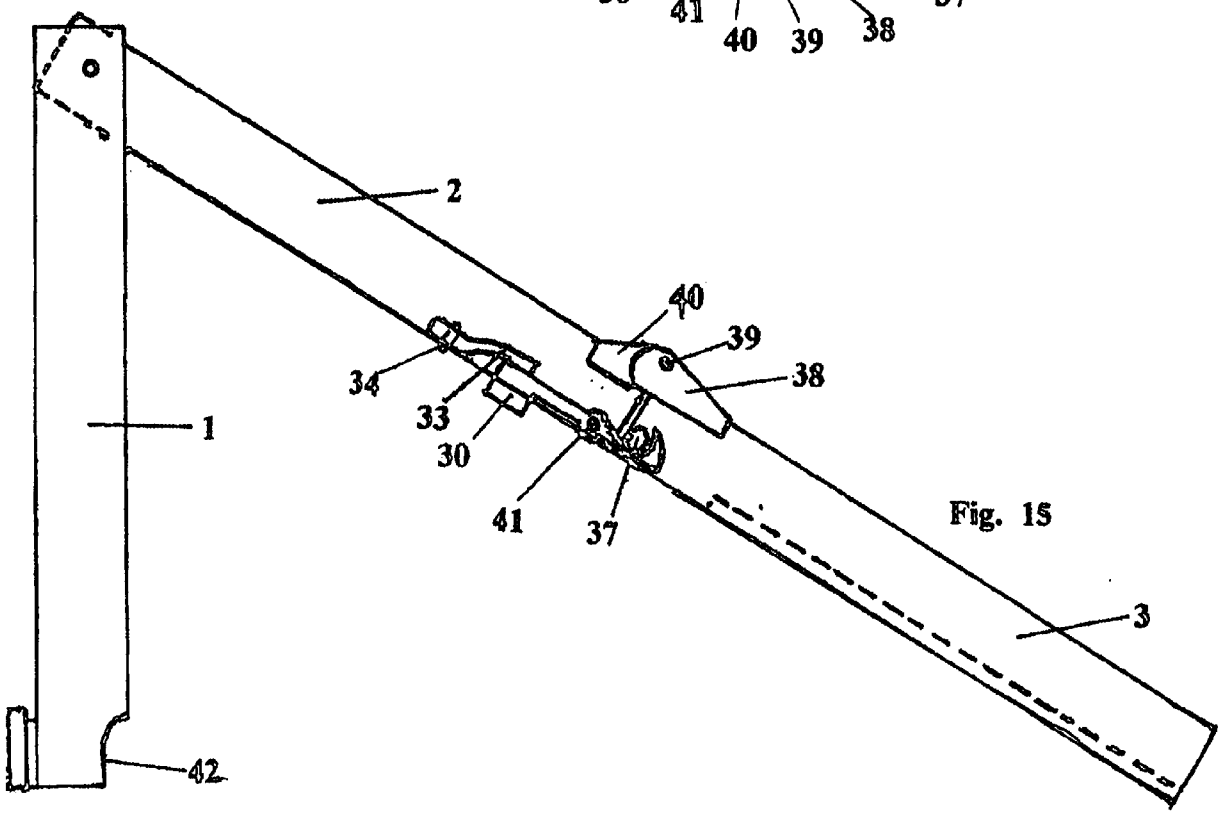
FIG. 15 shows the lateral view of the invention with the locked apparatus in place.
Figure 18:
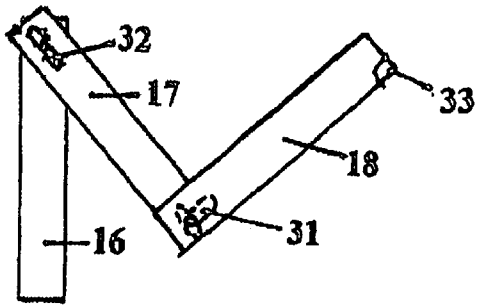
FIG. 18 shows the partially open position of the carpender's rule design.
Figure 19:
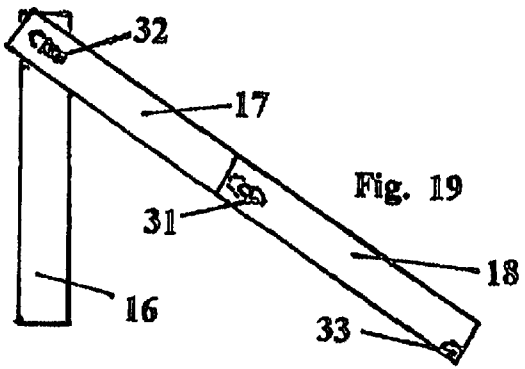
FIG. 19 shows the carpender's rule design in the extended and working position in the side view.

Another design for the collapsible greens meter is the design in FIG. 14. This design is very similar to the design in FIG. 6. The main differences are the hinge also on the top of the ramps 2 and 3, and the bottom latch. The hinge, made up of 38, 39, and 40 components, is located laterally and away from the ramps 2 and 3, the allows for the golf ball to roll down the ramp without being disrupted by the hinge. The bottom latch is made up of components 30, 41, and 37. There is a cutout 42 in the base stand 1 for the laterally placed hinge to fit into when in the closed position. The hinge portion 40 of ramp 2 is located laterally and protrudes slightly above the top of the ramp allowing the one half of the connecting bolt 39 to be above the level of the top of the ramp. This levering or connecting bolt 39 is also connected to ramp 3 by its hinge arm 38. The pin or bolt 39 only passes through these two components 40 and 38. The same occurs on the opposite side of the ramp. By the pin or levering bolt 39 being slightly above the ramp level allows the two ramps to close fully with ramp 3 folding back and on top of ramp 2. The latch 30 on the bottom is attached to ramp 2 by pin 41, that passes through the bottom edges of the ramp. The latch is located in a cutout on the bottom of ramp 2 allowing free movement of the latch 30. The ramp 3 has a locking rod 37 attached to its body allowing the latch is snap onto the rod easily when fully extended. It is then locked into position until released by 30. This is done by pressing the latch arm 30 into the cutout but restricted by spring 33 attached to the floor of ramp 2 by screw 34. This leaf spring 34 allows the latch 30 to release ramp 3 but then pushes it latch back into position for the repeat latching to occur when the ramp 3 is again extended.

Figure 17:
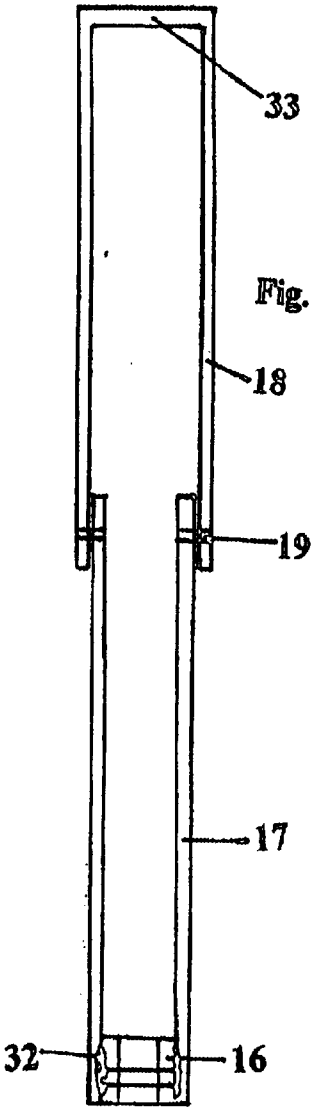
FIG. 17 shows the carpender's rule design, top view, with it in the extended and in the working position.
Figure 16:
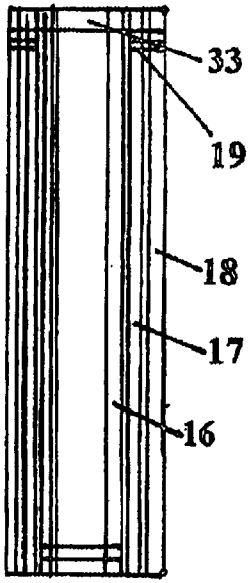
FIG. 16 shows another design available for the portable speed meter. This method works just as a carpender's rule does in it collapses in a folded position as it is here.

The last design presented FIGS. 16, 17, 18, and 19, is called the carpender's rule design. The device has ramps that collapse as a carpender's ride does and depends on strong detents and connections for accurate and steady positions. The base arm 16 is located on the most interior position and when rail 17 is extended as hi FIG. 18, the detents 32 lock the rail at this position, whereby the rail 18 can be further extended and it is locked to 17 by the detents 31. There is a small bottom bar 33 holding the ramps in the correct position and alignment at all times. FIG. 16 shows the collapsed position, with FIG. 17 showing a top view and FIG. 19 a lateral view of the fully extended position. The extended position reveals the ramp or rail 18 is slightly lateral to rail 17 allowing for a slight disruption at the connecting position. This does not seem to reduce the speed of the ball passing into the wider rail 18 from rail 17 but there is a slight interruption from the lane change. The ramp will perform the function of evaluating the ball speed well and accurately. position

I claim:

1. A collapsible speed measuring device for use on a golf green, said collapsible speed measuring device comprising:

an upright base stand, first hinge mounted on a first end of said base stand;

a pair of hinged rails, said rails being foldable about a second hinge to a jack-knife collapsed position on an extended operational position, one end of one of said rails being mounted to said first hinge to permit further folding of said rails about said stand wherein the rails are collapsed within the base stand;

a snap connection between the pair of hinged rails for maintaining the extended operational position of the hinged rails;

a plurality of surface detents on the hinged rails and the base stand to lock the rails in the extended operational position;

the extended operational position defining a guide alone which a golf ball is rolled to measure the speed of the golf green.

* * * * *